United States Patent [19]

Hirschbein

[11] Patent Number: 4,458,928

[45] Date of Patent: Jul. 10, 1984

[54] RIM TYPE PANIC EXIT ACTUATOR

[75] Inventor: Aaron M. Hirschbein, Diamond Bar, Calif.

[73] Assignee: Adams Rite Manufacturing Co., City of Industry, Calif.

[21] Appl. No.: 247,193

[22] Filed: Mar. 24, 1981

[51] Int. Cl.[3] ..... E05C 15/02; E05C 3/36; E05B 17/00

[52] U.S. Cl. ..... 292/92; 292/216; 292/279; 292/346

[58] Field of Search ..... 292/92, 213, 214, 215, 292/216, 217, 218, 279, 280, 346

[56] References Cited

U.S. PATENT DOCUMENTS

| | | | |
|---|---|---|---|
| 538,078 | 4/1895 | Kerler | 292/213 |
| 973,001 | 10/1910 | Churchill | 292/346 X |
| 1,036,346 | 8/1912 | Schmittberger | 292/279 X |
| 1,902,628 | 3/1933 | Endter | 292/279 X |
| 2,159,940 | 5/1939 | Endter | 292/279 X |
| 2,173,765 | 9/1939 | Potter | 292/280 X |
| 3,083,560 | 4/1963 | Scott | 292/216 X |
| 3,432,631 | 3/1969 | Deutscher et al. | 70/380 |
| 3,614,145 | 10/1971 | Zawadzki | 292/92 |
| 3,877,262 | 4/1975 | Williams | 292/92 X |
| 4,083,590 | 4/1978 | Folger | 292/92 |
| 4,130,306 | 12/1978 | Brkic | 292/21 X |
| 4,167,280 | 9/1979 | Godec et al. | 292/92 |

*Primary Examiner*—Thomas J. Holko
*Attorney, Agent, or Firm*—Whann & McManigal

[57] ABSTRACT

A panic exit door actuator and locking bolt mechanism of the rim type adapted for mounting in a horizontal position extending generally between the hinged edge and swingable edge of an exit door, wherein the locking bolt comprises a rotatable star wheel with a plurality of circumferentially spaced radial arms that are successively movable by rotation of the star wheel in one direction into salient bolted positions in which they are retained against reverse rotation to an unbolted position by a spring biased latch. The plane of rotation of the star wheel is traversed by the path of relative movement of a bar type strike mounted on the associated door frame, during closing movement of the door, whereupon the strike will engage one of the arms and rotate the star wheel to bring a following arm into a latched, bolted position overlying the strike. A cam actuator that is key-controlled from one side of the door, and a push bar mounted on the panic actuator mechanism on the opposite side of the door, are selectively manually operable to move the latch to a bolt-releasing position, whereupon the door may be moved in an opening direction during which the star wheel will engage the following arm and rotate the star wheel in a reverse direction so as to move the following arm from its previous bolted position to an unbolted position.

3 Claims, 8 Drawing Figures

FIG. 1
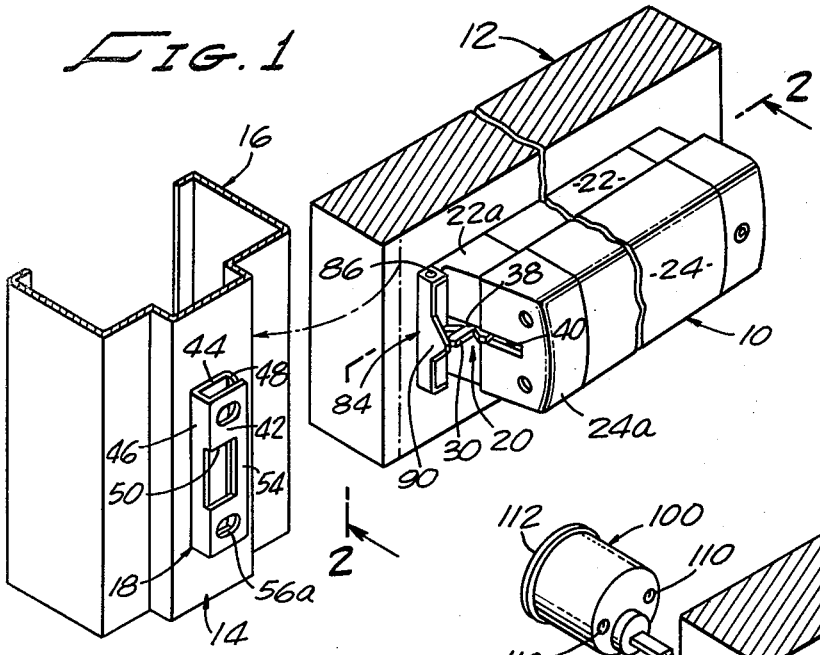
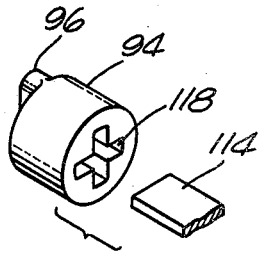
FIG. 7.
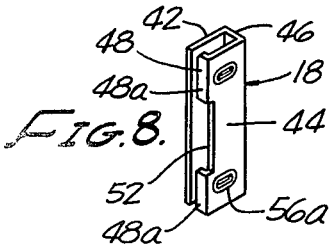
FIG. 8.
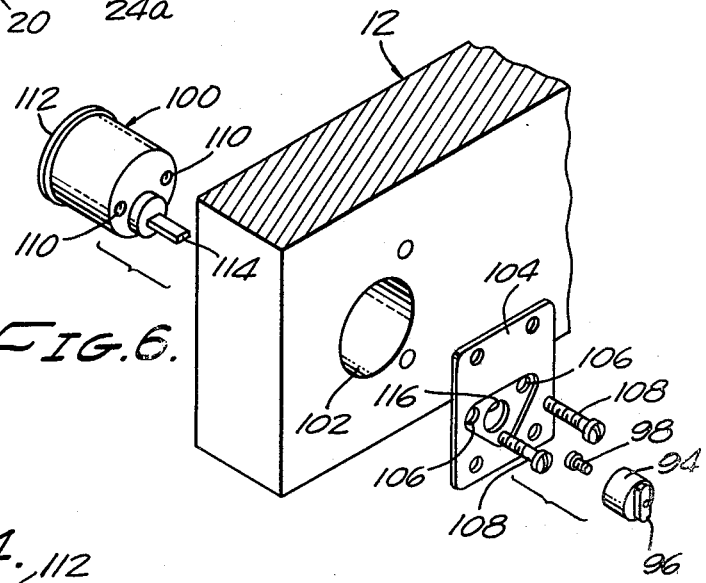
FIG. 6.
FIG. 4.
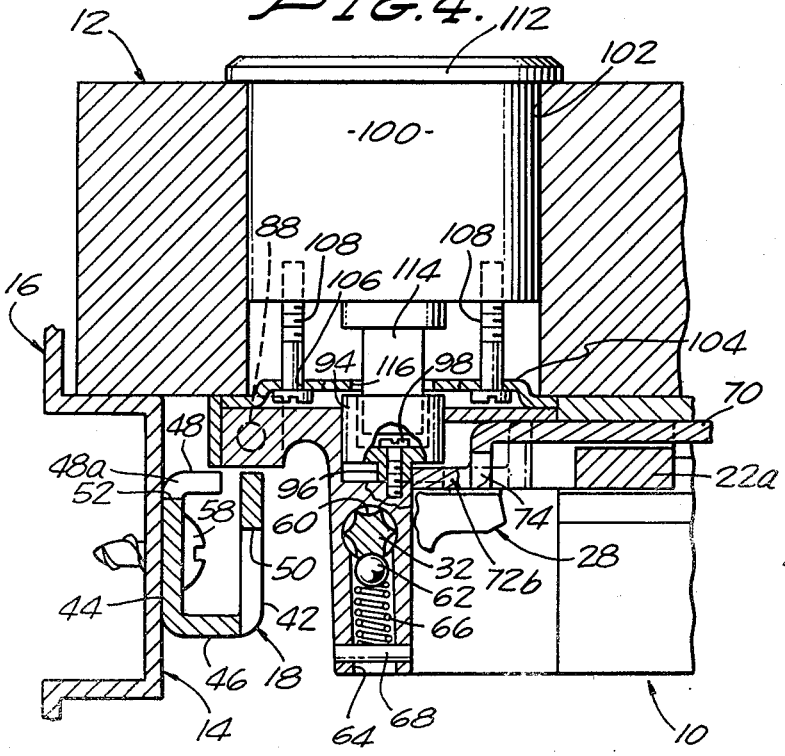
FIG. 5.
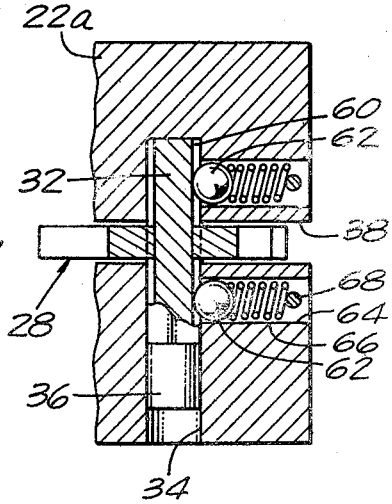

RIM TYPE PANIC EXIT ACTUATOR

BACKGROUND OF THE INVENTION

The present invention relates generally to the field of emergency exit devices for doors, and the like.

It has heretofore been generally known to provide safety exit devices which are fabricated as complete units for attachment to one face of an emergency exit door, and wherein each unit comprises a swingable latch or reciprocable bolt as a component part adapted in the closed position of the door for latching or locking engagement with an appropriate strike or keeper mounted on the associated door frame.

Such prior structures have been generally known from a number of prior patents which are exemplified by the Deutscher, et al., U.S. Pat. No. 3,432,631, dated Mar. 11, 1969, which utilizes a reciprocable locking bolt; and the Williams, U.S. Pat. No. 3,877,262, dated Apr. 15, 1975, which utilizes a swingable latch locking member. The mechanisms disclosed in these patents utilize a push bar rather than a pivotally supported manually operable panic bar. In either case, a potentially dangerous and hazardous condition may arise in an emergency situation by reason of the placement of load friction forces on the latch or reciprocable bolt, either due to the operation of the pushbar or the pivotally supported panic bar, or as a result of people crowding against the exit door and pushing it in an opening direction prior to its being unlatched or unbolted. Such load friction forces may thus seriously affect and even prevent opening of the door.

The above noted friction load forces have been materially reduced in a more recently issued, commonly owned Brkic, U.S. Pat. No. 4,130,306, dated Dec. 19, 1978, in which multiple bolts are arranged to be actuated by the panic bar mechanism, and wherein the top of the door frame is provided with a fixed header bolt or strike that is arranged to move the diverging fingers of a rotatable latch structure into a latched position, when the door is closed, and into a non-latched position, when the door is opened. A dogging member is operable to dog the latch in its latching position, when the door is closed.

According to the present invention, it is proposed to provide an improved and simplified panic exit door mechanism of the rim type, which will eliminate the undesirable inherent friction load forces that are characteristic of those panic exit door actuating mechanisms having a conventional reciprocable bolt or pivotally swingable latch, and particularly in those embodiments where the bolt is mounted at the end of the panic exit door actuating mechanism and is positioned adjacent the swinging edge of the door. For such purpose, the present invention utilizes a rotatable bolt member having a star wheel configuration. This star wheel is positioned at one end of the panic exit mechanism, and arranged to be rotatably actuated by an associated strike mounted on the door frame to a bolted and to an unbolted position, respectively, by the closing and opening movements of the door. Arms of the star wheel are successively rotatable in one direction of rotation into salient bolted positions as determined by spring detent means, and operably associated latch means are arranged to normally permit rotation of the star wheel to bring the arms into their bolted positions, but normally oppose rotation of the star wheel in a reverse direction that would move the active bolt positioned arm from its bolted position to a non-bolted position, until the latch is released either by the actuation of a key-controlled cam or by means of the manual actuation of the push bar on the panic exit mechanism.

SUMMARY OF THE INVENTION

The present invention is more specifically concerned with improvements in emergency panic exit door actuating mechanisms of the self-contained unit type which are susceptible of mounting as a unit on the inside of an exit door for emergency actuation, and wherein the bolt locking means is positioned at one end of the unit, and which more particularly relates to an exit device of the so-called rim type.

It is one object of the herein described invention to provide a simplified and improved emergency exit door locking mechanism in the form of an elongate unit assembly which can be mounted on the inside of the door, and which contains an elongate housing with an exposed push bar that is operatively connected with bolt locking means at one end of the housing, such locking means including a rotatable bolt structure having a plurality of generally radially extending angularly spaced arms adapted to selectively occupy a bolted position with respect to an associated strike structure.

A further object is to provide an exit door locking mechanism according to the preceding object, in which the angularly spaced arms are normally positioned in the relative path of travel of a strike member on an associated door frame, whereby as the door is closed the strike will engage one of the arms and move a following arm into a latch-held bolted position overlying the strike, and upon release of the holding latch by depressing the pushbar permit the following arm to be reversely moved by the strike, as the door is opened, in a manner to move the following arm in a reverse direction to a non-bolted position.

A further object is to provide an emergency door exit lock mechanism in which the bolt means comprises a rotatably mounted multi-armed star wheel and associated detent means which will be operative to successively position each of the star wheel arms in a salient bolted position in relation to an associated strike, together with spring urged latch means to normally oppose movement of the star wheel in a direction to move the active arm from its bolted position to a non-bolted position.

Another object is to provide an emergency door locking mechanism according to the preceding object, in which the latch means is selectively operable to a released position by camming means actuable by key-controlled means accessible from one side of the door, or by an exit push bar accessible from the other side of the door.

Another object is to provide in an emergency exit door locking mechanism, a rotatable star wheel bolt structure having bolt forming arms, and in which an operatively associated detent selectively positions the star wheel arms in salient bolted and non-bolted positions, and prevents inadvertent movement of the star wheel into an operative position.

It is still another object to provide in an emergency exit door locking mechanism, a rotatable star wheel with arms adapted to be respectively moved into bolting positions with respect to a door strike element, and in which a guard shielding member is positioned adjacent the exposed outer ends of the arms at their bolting positions for preventing unauthorized lateral movement of the strike from its bolted position by means of a pry-bar inserted inserted between the closed door edge and adjacent door frame.

It is also an object of the herein described invention to provide in an emergency exit door locking mechanism, a bolt engageable strike having wall portions which serve to provide a guard shield against unauthorized attempts to move the bolt forming member from its bolted position to an unbolted position by means of an elongate instrumentality inserted from the outside of a closed door between the door edge and associated door frame.

Further objects of the invention will be brought out in the following part of the specification, wherein detailed description is for the purpose of fully disclosing the invention without placing limitations thereon.

BRIEF DESCRIPTION OF THE DRAWINGS

Referring to the accompanying drawings, which are for illustrative purposes only:

FIG. 1 is a composite fragmentary perspective view showing a panic exit actuator according to the present invention as being mounted on the inside of an exit door, and its cooperative relationship with a strike mounted on an associated door frame;

FIG. 4 is an enlarged fragmentary sectional view, taken substantially on line 4—4 of FIG. 2, showing details of the interconnection between the bolt latching means and a manually operable key-controlled cam actuator;

FIG. 5 is a fragmentary sectional view, taken substantially on line 5—5 of FIG. 2, showing details of the detent means for positioning the radial arms of the bolt means in salient strike receiving and bolt operative positions;

FIG. 6 is an exploded perspective view, illustrating the manner and means for connectingly mounting a key-controlled cylinder in the door, and its connection with a cam actuator member;

FIG. 7 is an enlarged, exploded, fragmentary, perspective view illustrating further details of the interconnection between the key-controlled cylinder and the cam actuating member; and FIG. 8 is a perspective view of the strike element, as seen from its back side.

DESCRIPTION OF A PREFERRED EMBODIMENT

Figure 2:
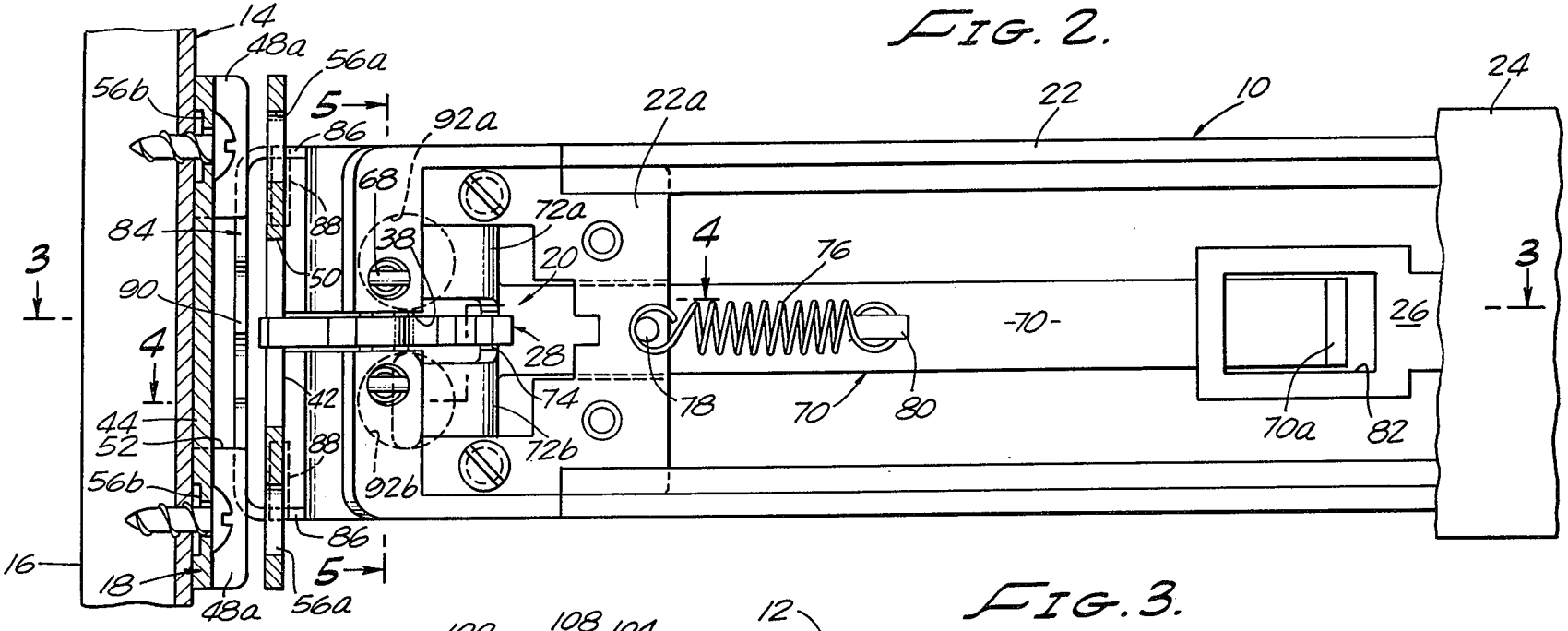
FIG. 2 is an enlarged fragmentary sectional view, taken substantially on line 2—2 of FIG. 1, and showing the details of the bolt means and its controllable connection with the mechanism of the panic exit actuator.

For illustrative purposes, there is disclosed in FIG. 1 a panic exit actuator according to the present invention, the actuator being generally indicated by the numeral 10 and comprising an elongate structure which is mounted on the inner face of an exit door, as generally indicated by the numeral 12, so as to extend generally in a horizontal mounted position between the hinged and swinging edges of the door. While for illustrative purposes, the panic actuator 10 has been disclosed on a solid type wooden door, it is to be understood that the actuator may, if desired, be mounted on doors which are fabricated with extruded frame members and which may mount a glass panel.

The door at its swinging edge is adapted in its closed position to engage against a stop 14 which may comprise a separate abutment strip mounted on the door frame or as shown may be integrally formed on one face of a conventional extruded door frame structural member 16. Regardless of the particular structure utilized, the stop mounts a strike member, as generally indicated by the numeral 18, this strike member being of the bar type and being arranged for operative engagement with bolt means 20, at the end of the panic actuator 10, which is contiguous to the swinging edge of the door 12.

Figure 3:
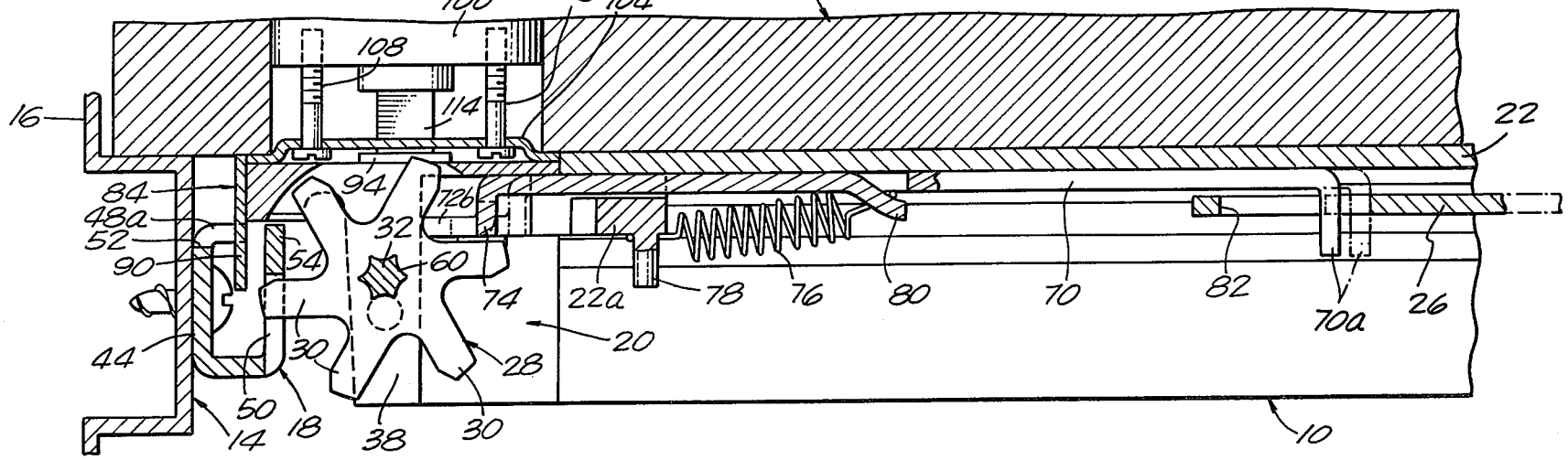
FIG. 3 is a transverse section, taken substantially on line 3—3 of FIG. 2, and showing further details of the operative relationship between the bolt means, the strike, and the bolt latching means.

The panic actuator 10 may be of any conventional construction, but should be preferably mechanically so designed as to deliver an endwise movement to a reciprocably mounted actuator member. Basically, the panic actuator 10 conforms generally to that disclosed in a commonly owned U.S. Patent of Roger J. Folger, U.S. Pat. No. 4,083,590, dated Apr. 11, 1978, which is incorporated herein by reference, and basically includes an elongate mounting base structure 22 and a coextensive exposed push bar 24 which is supported by an internal linkage mechanism (not shown) for movement towards and away from the base structure. The connecting linkage is operative to convert the push bar movements into reciprocable movements of the actuator link 26, as shown in FIGS. 2 and 3, such that when the push bar is depressed, the actuator link 26 will be moved towards the right. Spring means (not shown) normally urges the actuator link 26 towards a left limit position, as shown in full lines in FIGS. 2 and 3.

The bolt means is comprised of a star wheel 28 which is fabricated from a suitable plate material and has a plurality of circumferentially spaced radially extending arms 30. The star wheel is centrally supported upon an elongate axle or shaft 32, the ends of which project on opposite sides of the star wheel and are supported in the bearing surfaces formed by the inner walls of a blind bore 34 of a base end frame structure **22*a*, as best shown in FIG. 5. The shaft 32 is axially retained within the bore 34 by means of a roll pin 36 inserted through the open end of the bore. As thus mounted, the star wheel is arranged to rotate in a generally horizontal plane of rotation within a slot 38 in a manner such that the arms 30 may be successively moved into an exposed position traversed by the relative movement of the strike member during opening and closing movements of the door. An end cap 24*a* on the adjacent end of the push bar 24 is also provided with a slot 40 in which the star wheel is adapted to move during movement of the push bar in a direction towards the mounting base structure 22** during actuation of the panic actuator.

As previously mentioned, the strike is of the bar type and as such may assume a variety of configurations. However, as best disclosed in FIGS. 1 and 8, the preferred construction comprises a generally tubular member which is folded or otherwise formed from a sheet material to provide an elongate member of generally rectangular cross section with a front wall 42, a back wall 44, and side walls 46 and 48 respectively. The front wall 42 and adjacent side wall 48 are provided with openings 50 and 52 which coact to form a strike bar portion 54 adapted for engagement and disengagement with the active arms of the bolt means 20 during movement of the door to closed and opened positions.

As shown in FIG. 8, the opening 52 is positioned between a pair of end wall portions **48*a*. Provision is made for attaching the strike member 18 to the stop 14, and for this purpose, screw receiving openings are provided at each end of the strike member. For this purpose, the front wall 42 and rear wall 44, at each end of the strike, are respectively provided with openings 56***a* and 56*b*, these openings being in axial alignment. The opening 56*a* is larger than the opening 56*b* in order to permit passage of the screw head through the opening 56*a*, but prevent passage of the head through the opening 56*b*, when the screw 58 is in a retaining position, as shown in FIG. 4. As thus constructed and mounted, the wall portions of the strike provide a guard shield against unauthorized attempts to move the bolt forming arm of the bolt means from its bolted position to an unbolted position by means of an elongate instrumentality inserted from the outside of a closed door.

Detent means are provided for assuring that the arms of the star wheel will not inadvertently be moved to a position in which the strike bar portion 54 would not properly be received between an adjacent pair of star wheel arms into an operative position which would rotate the star wheel as the door is moved to a closed position. For this purpose, the detent means is arranged to automatically position star wheel arms in a proper strike receiving and bolt operating position. For this purpose, as best shown in FIGS. 4 and 5, the shaft 32 is fabricated to provide circumferentially spaced longitudinally extending flutes 60 which are arranged to successively seatingly receive detent balls 62 on opposite sides of the star wheel at the respective salient positions thereof. Each of the detent balls is supported for axial movement in a bore passage 64 formed in the base end structure 22*a*. Each ball 62 is biased towards a seated position by a compression spring 66, one end of this spring being in engagement with the ball and the other end being in engagement with a retaining pin 68 extending across the outer open end of the bore passage 64.

As best shown in FIGS. 2 and 3, provision is made for latching means which will permit the star wheel to be freely rotated in one direction in order to successively move the star wheel arms into the salient operating positions as determined by the detent means, and which will further automatically latch the star wheel against reverse direction of movement from a bolted position until such time as the latch may be motivated to a latch release position by means of manually operable actuator means as will hereinafter be described in detail.

More specifically, the latch means is shown as comprising an elongate link member 70 which is appropriately supported on the mounting base structure 22 for axial reciprocal movements. At its outer end, the link member 70 is fabricated to provide a pair of spaced offset end finger portions 72*a* and 72*b*, which are in straddling relation to the plane of rotation of the arms of the star wheel on the inner side of the shaft 32. At the base of the end fingers, in the space therebetween, there is provided an upstanding abutment projection 74 which is adapted in the latching position of the link member 70 to underlie an adjacent star wheel arm and prevent rotation of the star wheel in a reverse direction from a bolted position of an arm on the opposite side of the shaft 32 which is in a position overlying the strike bar portion 54, when the door is closed and bolted. The latching position of the link member 70 is determined by the abutment of the outer ends of the finger portions 72*a* and 72*b* with an adjacent surface of the base end structure 22*a*. The link member 70 is normally urged towards a latching position with respect to the star wheel arms by means of a tension spring 76 having one end engaged with an anchor post 78 on the base end structure 22*a* and its other end engaged with the a struck up prong 80 of the link member 70.

The other end of the link member 70 is connected through a lost motion connection with the actuator link 26. As shown, this lost motion connection comprises an elongate slot 82 which is formed in the adjacent end of the actuator link and and a deflected end portion 70*a* of the link member 70, this end portion providing in effect a pin which is relatively movable on the longitudinal axis within the slot 82. In the normal latched position of the link member 70, and when the push bar 24 is in its normal inactive position, the end portion 70*a* will have a normal position in spaced relation to the slot ends, as shown in full lines. As thus arranged, the link member 70 is free to be moved to an unlatched position, as shown in phantom lines in FIG. 3, by means other than the panic actuator, for example, by alternative actuating means such as a key-controlled rotatable cam member which will subsequently be described in detail. When the push bar 24 is depressed to unlock the door, the actuator link 26 will be moved towards the right. During the final portion of this movement, the portion of the link at the outer end of the slot 82 will engage the link end portion 70*a* and thereby move the link 70 to a latch released position.

Again referring to FIG. 1, the bolt functioning arms 30 are further shielded and guarded against unauthorized opening by probe instrumentalities by means of a guard member 84 fabricated from a plate material and having deflected end portions 86 which are adapted to extend over adjacent portions of the base end structure 22*a* to which it may be secured by appropriate groove pins 88 as best shown in FIG. 2. Intermediate its ends, the guard member 84 is formed with a laterally projecting edge bulge 90 which extends over the exposed end of the associated arm 30, when that arm is in a bolted position. It will also be seen that in the closed position of the door, the edge bulge 90 projects into the strike member 18 through the opening 52. The guard member 84 and the strike member 18 thus mutually coact to protect and guard the bolt means 20 against unauthorized opening attempts by means of probes and other instrumentalities.

The alternate key-controlled actuating means will now be described. Referring more specifically to FIGS. 2, 4 and 6, the base end structure 22*a* is provided with a pair of back opening bores 92*a* and 92*b* which are positioned on opposite sides of the rotatable star wheel 28. These bores are respectively at the outer ends of the end finger portions 72*a* and 72*b* of the link member 70. The bores provide for the selective rotatable mounting therein of a cylindrical cam actuating member 94, as shown in FIG. 7, this member being formed at one end with a cam 96 which is adapted upon rotation to engage the associated end finger portion 72*a* or 72*b*, depending upon which bore the cylindrical cam actuating member is mounted in, and upon rotation to actuate the link member 70 to a released position with respect to the star wheel 28. The two bores 92*a* and 92*b* provide for selective mounting of the cylindrical cam actuating member 94 in order to accomodate this actuating means to either left or right swinging hinged doors.

As best shown in FIG. 4, the cylindrical cam actuating member 94 is retained within the associated bore by means of a retaining screw 98 having threaded engagement with a suitably tapped opening in the bottom wall of the bore.

The cylindrical cam actuating member 94 is operably connectable for operation by means of a conventional key-controlled lock cylinder 100 which is mounted on the door. The mounting means for the lock cylinder may vary somewhat depending upon the door structure. For illustrative purposes, the lock cylinder is shown in FIGS. 4 and 6 as being mounted upon a solid wooden door structure. In such case, a suitable transversely extending bore opening 102 is provided of a suitable size to receive the lock cylinder endwise therein. The cylinder is retained in a mounted position by means of a face plate 104 which is placed upon the inner face of the door and arranged with suitable holes 106 for the passage of retaining screws 108 for engagement at their innermost ends with threaded openings 110 in the adjacent end of the lock cylinder. By tightening the screws 108, the lock cylinder 100 is clampingly mounted and held in operative position by means of the face plate 104 and a peripheral end flange 112. AS thus mounted, a connection tailpiece 114 extends through an opening 116 on the face plate into a driving connection socket 118 formed in the adjacent end of the cylindrical cam actuating member 94. Since the locked orientation of the tail piece 14 may differ in different cylinder structures by 90°, the socket 118 is of a cross-configuration to accomodate this variation in the normal disposition of the tailpiece in the various lock cylinder models. The key-controlled cam actuating means as described above permits actuation of the link member 70 to a bolt released position, and opening of the door independently of the actuation by the push bar 24.

From the foregoing description and drawings, it will be clearly evident that the delineated objects and features of the invention will be accomplished.

Various modifications may suggest themselves to those skilled in the art without departing from the spirit of my invention, and, hence, I do not wish to be restricted to the specific forms shown or uses mentioned, except to the extent indicated in the pending claims.

I claim:

1. A panic exit door bolt and actuator mechanism comprising:

a housing adapted for horizontal external mounting on one face of said door;

bolt means at one end of said housing movable into bolted and unbolted relation with respect to a strike supported on an associated upright door frame, respectively, by the closing and opening movements of said door;

movable latch means within said housing normally enabling movement of the bolt means to said bolted position, but opposing movement to said unbolted position, comprising:

an elongate link member supported for longitudinal reciprocable movement;

spring means normally biasing said link member in a direction towards a fixed stop limit position opposing movement of said bolt means to said unbolted position;

manually operable means including a key-controlled rotatable cam member operable from one face of said door to move said latch means to a position enabling movement of said bolt means to said unbolted position by the opening movement of the door, said cam member being selectively mountable on opposite sides of the link member axis to adapt the manually operable key-controlled means for right and left hand swinging doors; and connection means between said latch means and said manually operable means including laterally spaced end finger portions positioned on opposite sides of the longitudinal axis of said link member engageable, upon rotation of said cam member, to move said link member in a direction away from said opposing position.

2. A panic exit door bolt and actuator mechanism comprising:

a housing adapted for horizontal external mounting on one face of said door;

bolt means at one end of said housing movable into bolted and unbolted relation with respect to a strike supported on an associated upright door frame, respectively, by the closing and opening movements of said door, said bolt means comprising a star wheel supported on a rotatably mounted shaft and having a plurality of generally radially extending angularly spaced arms movable in a plane of rotation traversed by said strike during movement of the door to a closed position, whereby upon engagement of the strike with any one of said arms, as the door is closed, it will rotate a following arm into overlying bolted relation to said strike;

detent means operable to position the star wheel at discrete circumferential positions and with one of its arms at such position occupying a bolted position, said detent means comprising:

flutes peripherally formed on said shaft, spring urged ball means adapted to successively seat in said flutes as the star wheel is rotated from one discrete position to another;

movable latch means within said housing normally enabling movement of the bolt means to said unbolted position; and manually operable means accessible from one face of said door to move the latch means to a position enabling movement of said bolt means to said unbolted position by the opening movement of the door.

3. The mechanism according to claim 2, wherein:

said shaft has end portions extending from opposite sides of said star wheel;

bearings respectively support the shaft ends; and the spring urged ball means comprises a spring urged ball engageable with the flutes of each shaft end.

* * * * *